US011591923B1

(12) United States Patent
Mun et al.

(10) Patent No.: US 11,591,923 B1
(45) Date of Patent: Feb. 28, 2023

(54) RING SEGMENT AND TURBINE INCLUDING THE SAME

(71) Applicant: DOOSAN ENERBILITY CO., LTD., Changwon-si (KR)

(72) Inventors: Young Gi Mun, Bucheon (KR); Ha Neul Kim, Changwon (KR); Jae Yeon Choi, Busan (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/935,116

(22) Filed: Sep. 25, 2022

(30) Foreign Application Priority Data

Nov. 30, 2021 (KR) ..... 10-2021-0169166

(51) Int. Cl.
*F01D 11/08* (2006.01)
*F01D 25/12* (2006.01)

(52) U.S. Cl.
CPC ..... *F01D 11/08* (2013.01); *F01D 25/12* (2013.01); *F05D 2220/32* (2013.01); *F05D 2240/11* (2013.01); *F05D 2240/55* (2013.01); *F05D 2260/20* (2013.01)

(58) Field of Classification Search
CPC ..... F01D 11/08; F01D 25/12; F05D 2220/32; F05D 2240/11; F05D 2240/55; F05D 2260/20
See application file for complete search history.

(56) References Cited

U.S. PATENT DOCUMENTS

| | | | | |
|---|---|---|---|---|
| 7,374,395 | B2 * | 5/2008 | Durocher | F01D 25/12 415/115 |
| 7,520,715 | B2 * | 4/2009 | Durocher | F01D 9/04 415/176 |
| 9,017,012 | B2 | 4/2015 | Brunelli | |
| 2007/0020086 | A1 * | 1/2007 | Durocher | F01D 11/08 415/115 |
| 2007/0020087 | A1 * | 1/2007 | Durocher | F01D 11/08 415/115 |
| 2007/0020088 | A1 * | 1/2007 | Durocher | F01D 11/24 415/115 |
| 2008/0232963 | A1 * | 9/2008 | Durocher | F01D 9/04 416/97 R |

FOREIGN PATENT DOCUMENTS

| | | | |
|---|---|---|---|
| JP | 2004100682 | A | 4/2004 |
| JP | 2009-501860 | A | 1/2009 |
| KR | 101833662 | B1 | 2/2018 |
| KR | 102153065 | B1 | 9/2020 |
| KR | 102238866 | B1 | 4/2021 |
| KR | 20210102554 | A | 8/2021 |

* cited by examiner

*Primary Examiner* — Eldon T Brockman
(74) *Attorney, Agent, or Firm* — Harvest IP Law LLP

(57) ABSTRACT

Disclosed herein are a ring segment having an air pouch and a first cooling hole formed therein, and a turbine including the same. The air pouch and the first cooling hole are formed in a shield wall, thereby achieving an improvement in cooling performance as well as simplification of production process.

20 Claims, 11 Drawing Sheets

RING SEGMENT AND TURBINE INCLUDING THE SAME

CROSS-REFERENCE TO RELATED APPLICATION

This application claims priority to Korean Patent Application No. 10-2021-0169166, filed on Nov. 30, 2021, the disclosure of which is incorporated herein by reference in its entirety.

BACKGROUND

Technical Field

Exemplary embodiments relate to a ring segment and a turbine including the same, and more particularly, to a ring segment having an air pouch and a first cooling hole formed therein, and a turbine including the same.

Related Art

A gas turbine is a power engine that mixes air compressed by a compressor with fuel for combustion and rotates a turbine with hot gas produced by the combustion. The gas turbine is used to drive a generator, an aircraft, a ship, a train, etc.

The gas turbine typically includes a compressor, a combustor, and a turbine. The compressor sucks in and compresses outside air, and then transmits the compressed air to the combustor. The air compressed by the compressor becomes high-pressure and high-temperature air. The combustor mixes the compressed air flowing thereinto from the compressor with fuel and burns a mixture thereof. The combustion gas produced by the combustion is injected into the turbine. The injected combustion gas generates rotational force while passing through turbine vanes and turbine blades, thereby rotating the rotor of the turbine.

In order to prevent the leakage of the high-temperature and high-pressure combustion gas used for rotation of the rotor and thus to increase the efficiency of the gas turbine, the turbine is equipped therein with ring segments. The ring segments are installed in a turbine casing that accommodates the turbine blades, and are positioned to surround the outer peripheries of the rotating turbine blades. In this case, one surface of each of the ring segments facing the internal space of the turbine casing may be exposed to high-temperature and high-pressure combustion gas, resulting in a high heat load which may cause the breakage of the ring segment. In order to prevent the ring segment from breaking due to the heat load, the ring segment has a plurality of cooling passages formed therein. Besides, a cooling structure has been continuously researched and developed to prevent the breakage of the ring segment caused by the heat load while improving cooling efficiency.

SUMMARY

Aspects of one or more exemplary embodiments provide a ring segment with improved cooling performance as well as a simplified production process, and a turbine including the same.

Additional aspects will be set forth in part in the description which follows and, in part, will become apparent from the description, or may be learned by practice of the exemplary embodiments.

According to an aspect of an exemplary embodiment, there is provided a ring segment mounted in a casing for accommodating a turbine blade. The ring segment includes a shield wall, a first hook, a second hook, an air pouch, and at least one first cooling hole. The shield wall has an outer side that faces an inner wall of the casing and an inner side that faces an outer periphery of the turbine blade. The first and second hooks protrude from the outer side of the shield wall toward the casing for coupling therewith, extend in a circumferential direction of the turbine, and accommodate a cooling fluid therebetween. The air pouch is recessed from the outer side of the shield wall toward the turbine blade, and has one side which is flush with an inner surface of the second hook. The first cooling hole has an inlet in communication with the air pouch and an outlet in communication with an outside of the first hook in the shield wall.

The turbine blade may include an airfoil having a leading edge and a trailing edge formed thereon. The second hook may be located closer to the trailing edge than the leading edge.

The air pouch may have a recessed depth deeper than the inlet of the first cooling hole.

The first cooling hole may consist of a plurality of first cooling holes. The plurality of first cooling holes may be arranged parallel to each other or radially with respect to the air pouch.

The air pouch may have a bottom with a round portion formed at an edge thereof.

The air pouch may extend in the circumferential direction of the turbine, and be parallel to the second hook when viewed from above.

The shield wall may have a first side hole formed through a first side thereof and a second side hole formed through a second side thereof.

At least one of the first and second side holes may communicate with the air pouch, and the remainder may communicate with the first cooling hole.

In two ring segments adjacent to each other, the first side hole of one ring segment may be disposed alternatively with the second side hole of the other ring segment adjacent to the first side hole.

The shield wall may be cast with the air pouch formed therein. The first cooling hole may be formed by machining after the shield wall is cast.

The ring segment may further include at least one second cooling hole having a second inlet in communication with the air pouch and a second outlet in communication with an outside of the second hook in the shield wall.

According to an aspect of another exemplary embodiment, there is provided a turbine that includes a rotatable turbine rotor disk, a plurality of turbine blades, a casing, and a ring segment. The plurality of turbine blades are disposed on the turbine rotor disk and each include an airfoil having a leading edge and a trailing edge formed thereon. The casing accommodates the turbine blades. The ring segment is mounted in the casing. The ring segment includes a shield wall, a first hook, a second hook, an air pouch, and a first cooling hole. The shield wall has an outer side that faces an inner wall of the casing and an inner side that faces an outer periphery of the turbine blade. The first and second hooks protrude from the outer side of the shield wall toward the casing for coupling therewith, extend in a circumferential direction of the turbine, and accommodate a cooling fluid therebetween. The air pouch is recessed from the shield wall toward the turbine blade, and has one side which is flush with an inner surface of the second hook. The first cooling hole has an inlet in communication with the air pouch and an outlet in communication with an outside of the first hook in the shield wall.

The air pouch may have a recessed depth deeper than the inlet of the first cooling hole.

The first cooling hole may consist of a plurality of first cooling holes. The plurality of first cooling holes may be arranged parallel to each other or radially with respect to the air pouch.

The air pouch may have a bottom with a round portion formed at an edge thereof.

The air pouch may extend in the circumferential direction of the turbine, and be parallel to the second hook when viewed from above.

The shield wall may have a first side hole formed through a first side thereof and a second side hole formed through a second side thereof.

At least one of the first and second side holes may communicate with the air pouch, and the remainder may communicate with the first cooling hole.

In two ring segments adjacent to each other, the first side hole of one ring segment may be disposed alternatively with the second side hole of the other ring segment adjacent to the first side hole.

The turbine may further include at least one second cooling hole having a second inlet in communication with the air pouch and a second outlet in communication with the outside of the second hook in the shield wall.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
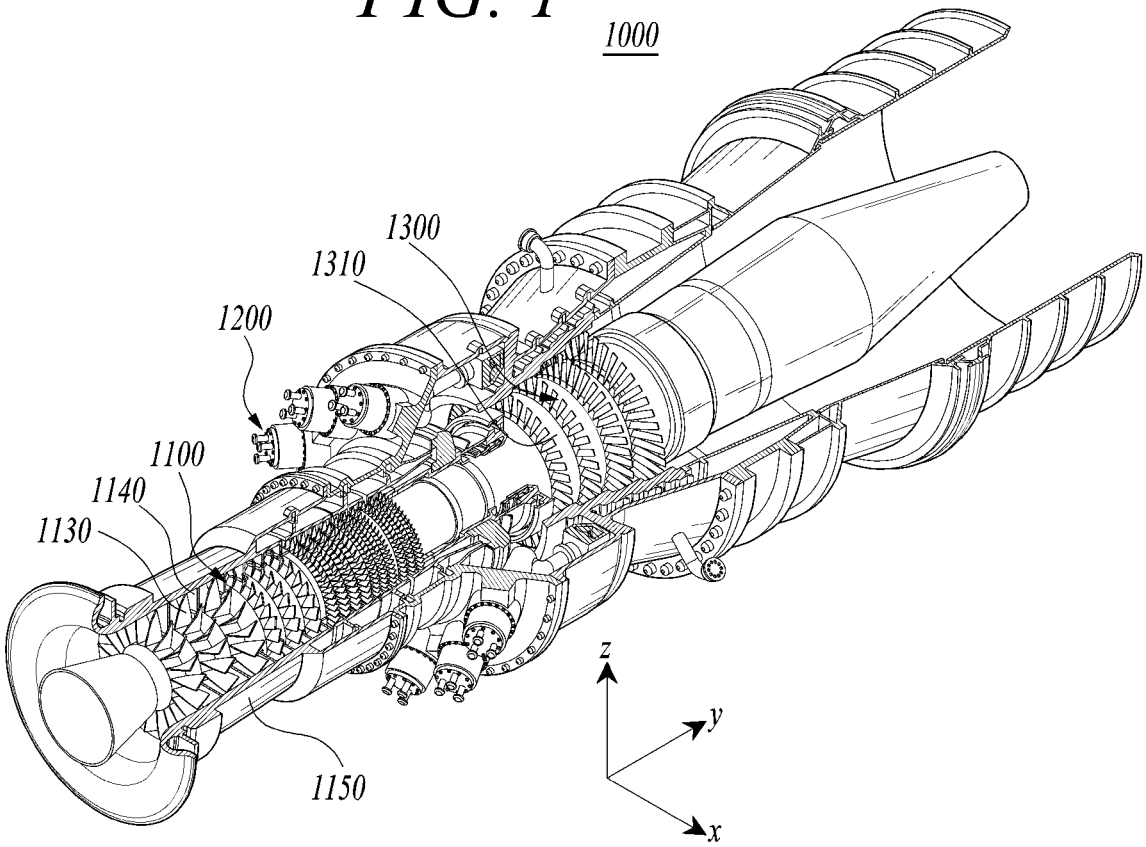
FIG. 1 is a perspective view illustrating an internal state of a gas turbine according to an exemplary embodiment.

Various modifications and different embodiments will be described below in detail with reference to the accompanying drawings so that those skilled in the art can easily carry out the disclosed invention. It should be understood, however, that the present disclosure is not intended to be limited to the specific embodiments, but the present disclosure includes all modifications, equivalents or replacements that fall within the spirit and scope of the disclosure as defined in the following claims.

The terminology used herein is for the purpose of describing specific embodiments only and is not intended to limit the scope of the disclosure. As used herein, the singular forms "a", "an" and "the" are intended to include the plural forms as well, unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. It should be noted that like reference numerals refer to like parts throughout various drawings and exemplary embodiments. In certain embodiments, a detailed description of functions and configurations well known in the art may be omitted to avoid obscuring appreciation of the disclosure by those skilled in the art. For the same reason, some components may be exaggerated, omitted, or schematically illustrated in the accompanying drawings.

Hereinafter, a ring segment and a turbine including the same according to exemplary embodiments will be described in detail with reference to the accompanying drawings.

Figure 2:
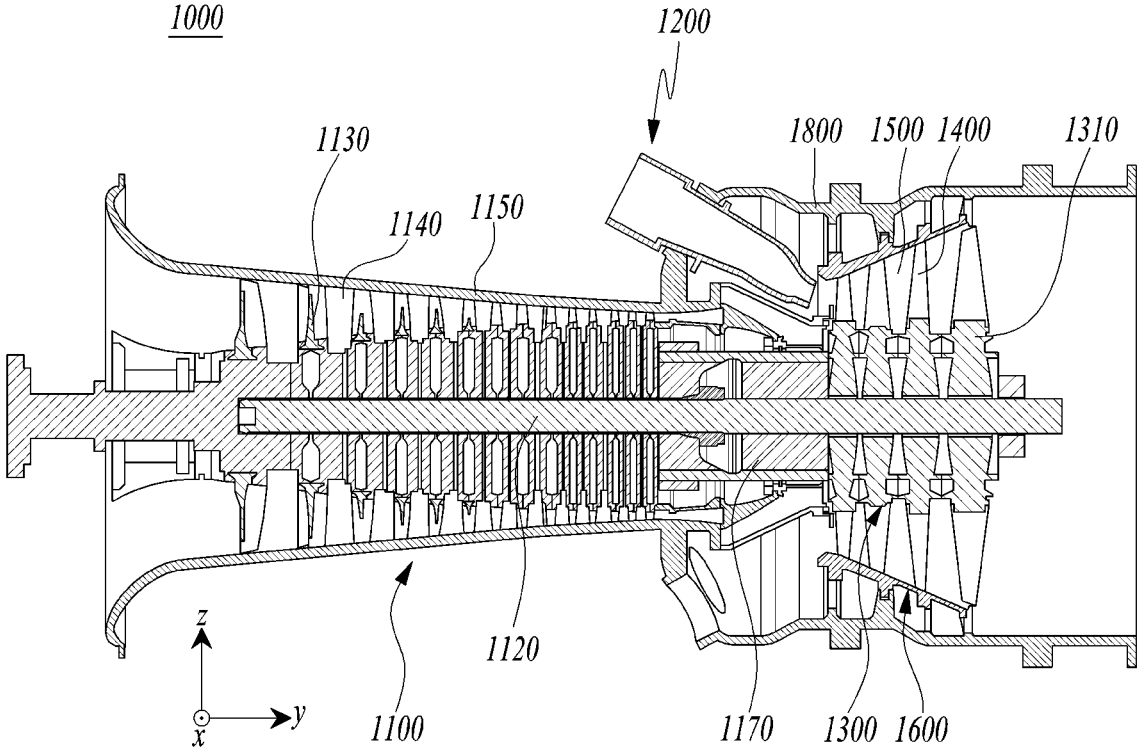
FIG. 2 is a partial cross-sectional view illustrating the gas turbine of FIG. 1.

FIG. 1 is a perspective view illustrating an internal state of a gas turbine according to an exemplary embodiment. FIG. 2 is a partial cross-sectional view illustrating the gas turbine of FIG. 1.

Referring to FIGS. 1 and 2, the thermodynamic cycle of the gas turbine, which is designated by reference numeral 1000, according to the exemplary embodiment may ideally follow a Brayton cycle. The Brayton cycle may consist of four phases including isentropic compression (adiabatic compression), isobaric heat addition, isentropic expansion (adiabatic expansion), and isobaric heat dissipation. In other words, in the Brayton cycle, thermal energy may be released by combustion of fuel in an isobaric environment after the atmospheric air is sucked in and compressed to high pressure air, hot combustion gas may be expanded to be converted into kinetic energy, and exhaust gas with residual energy may then be discharged to the atmosphere. The Brayton cycle may consist of four processes, i.e., compression, heating, expansion, and exhaust.

The gas turbine 1000 using the above Brayton cycle may include a compressor 1100, a combustor 1200, and a turbine 1300, as illustrated in FIG. 1. Although the following description is given with reference to FIG. 1, the present disclosure may be widely applied to any turbine engine having the same configuration as the gas turbine 1000 exemplarily illustrated in FIG. 1.

Referring to FIGS. 1 and 2, the compressor 1100 of the gas turbine 1000 may suck air from the outside and compress the air. The compressor 1100 may supply the combustor 1200 with the air compressed by compressor blades 1130, and may supply cooling air to a hot region required for cooling in the gas turbine 1000. In this case, since the air sucked into the compressor 1100 is subject to an adiabatic compression process therein, the pressure and temperature of the air that has passed through the compressor 1100 increase.

The compressor 1100 is designed as a centrifugal compressor or an axial compressor. In general, the centrifugal compressor is applied to a small gas turbine, whereas the multistage axial compressor 1100 is applied to the large gas turbine 1000 as illustrated in FIG. 1 because it is necessary to compress a large amount of air. In the multistage axial compressor 1100, the blades 1130 of the compressor 1100 rotate along with the rotation of rotor disks together with a center tie rod 1120 to compress air introduced thereinto while delivering the compressed air to rear-stage compressor vanes 1140. The air is compressed increasingly to high pressure air while passing through the compressor blades 1130 formed in a multistage manner.

A plurality of compressor vanes 1140 may be formed in a multistage manner and mounted in a compressor casing 1150. The compressor vanes 1140 guide the compressed air to enable the compressed air to flow from front-stage compressor blades 1130 to rear-stage compressor blades 1130. In an exemplary embodiment, at least some of the plurality of compressor vanes 1140 may be mounted so as to be rotatable within a fixed range for regulating the inflow rate of air or the like.

The compressor 1100 may be driven by some of the power output from the turbine 1300. To this end, the rotary shaft of the compressor 1100 may be directly connected to the rotary shaft of the turbine 1300 by a torque tube 1170, as illustrated in FIG. 2. In the large gas turbine 1000, the compressor 1100 may require almost half of the power generated by the turbine 1300 for driving the compressor 1100.

Meanwhile, the combustor 1200 may mix the compressed air, which is supplied from the outlet of the compressor 1100, with fuel for isobaric combustion to produce combustion gas with high energy. The combustor 1200 mixes fuel with the compressed air introduced thereinto and burns a mixture thereof to produce high-temperature and high-pressure combustion gas with high energy. The combustor 1200 increases the temperature of the combustion gas to a heat-resistant limit of combustor and turbine components through an isobaric combustion process.

The combustor 1200 may consist of a plurality of combustors arranged in a combustor casing in the form of a shell. Each of the combustors includes a burner having a fuel injection nozzle and the like, a combustor liner defining a combustion chamber, and a transition piece serving as the connection between the combustor and the turbine.

The high-temperature and high-pressure combustion gas coming out of the combustor 1200 is supplied to the turbine 1300. The high-temperature and high-pressure combustion gas supplied to the turbine 1300 applies impingement or reaction force to turbine blades 1400 while expanding, which results in rotational torque. The resultant rotational torque is transmitted to the compressor 1100 via the torque tube 1170, and power exceeding the power required to drive the compressor 1100 is used to drive a generator or the like.

The turbine 1300 includes rotor disks 1310, a turbine casing 1800, a plurality of turbine blades 1400 radially arranged on each of the rotor disks 1310, a plurality of turbine vanes 1500, and a plurality of ring segments 1600 surrounding the turbine blades 1400.

Each of the rotor disks 1310 has a substantially disk shape and has a plurality of grooves formed on the outer peripheral portion thereof. The grooves are each formed to have a curved surface so that the turbine blades 1400 are inserted into the grooves, and the turbine vanes 1500 are mounted in the turbine casing 1800. The turbine casing 1800 is formed of a frustoconical tube, and the turbine blades 1400, the vanes 1500, and the ring segments 1600 are accommodated in the turbine casing 1800.

The turbine blades 1400 may be coupled to the rotor disk 1310 in a dovetail manner or the like. The turbine vanes 1500 are fixed so as not to rotate and serve to guide a direction of flow of the combustion gas that has passed through the turbine blades 1400.

Figure 3:
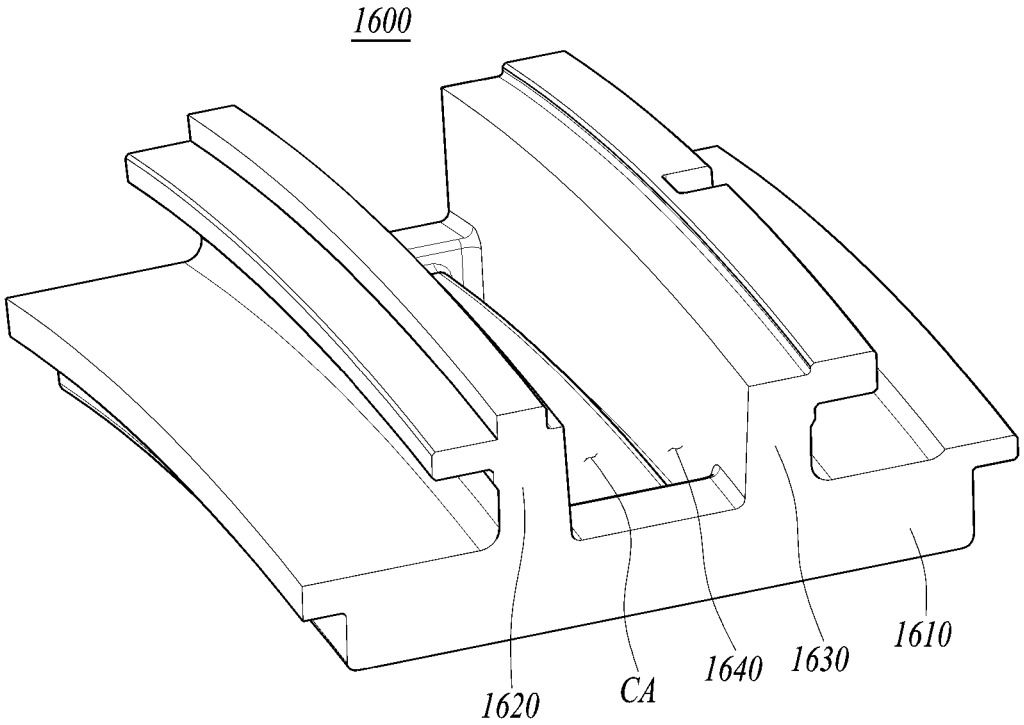
FIG. 3 is a perspective view illustrating a state of one ring segment according to a first exemplary embodiment.
Figure 4:
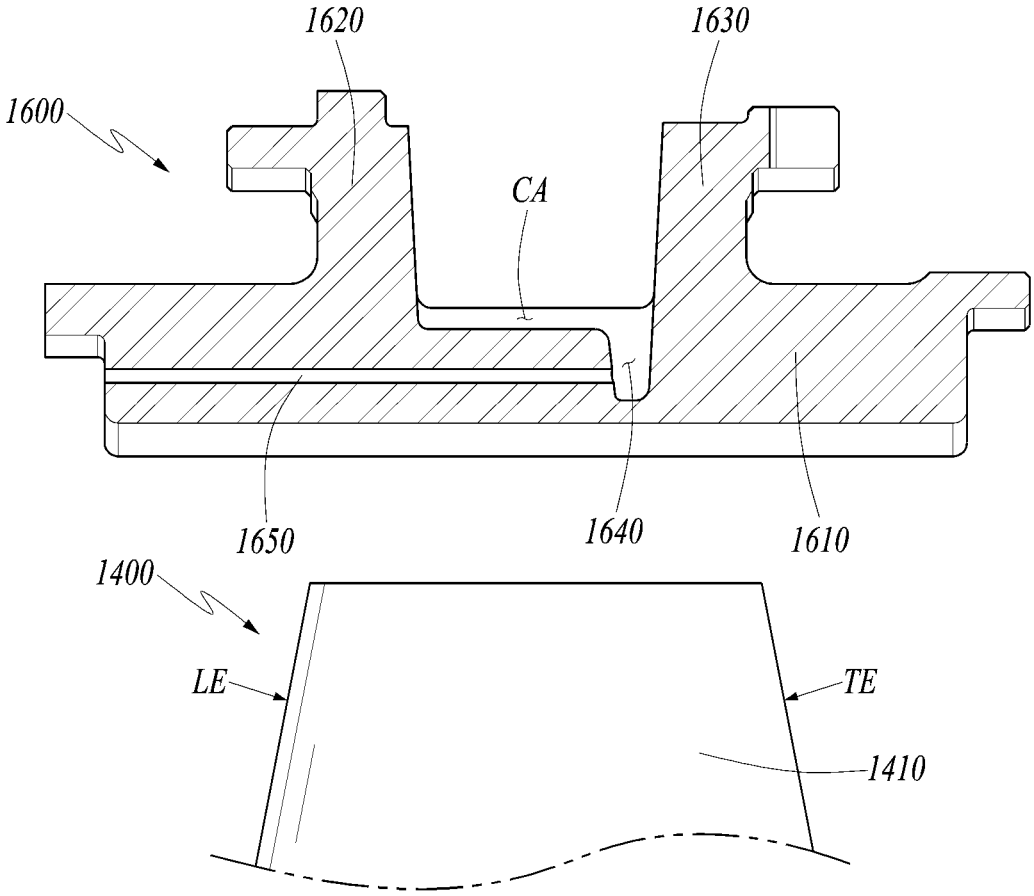
FIG. 4 is a side cross-sectional view illustrating the ring segment and outer peripheries of a turbine blade located radially inward of an associated ring segment according to the first exemplary embodiment.
Figure 5:
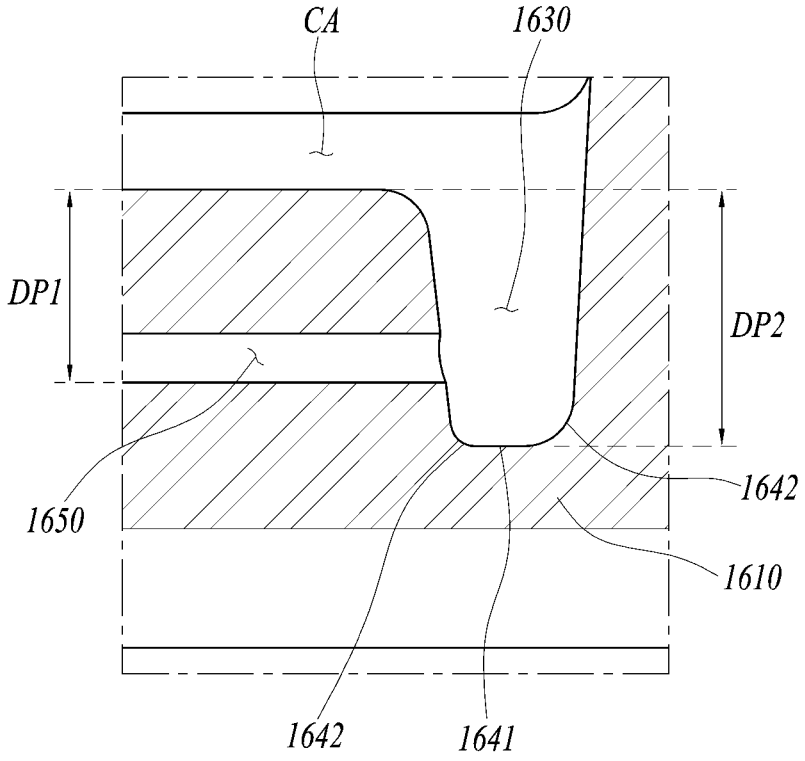
FIG. 5 is an enlarged side cross-sectional view illustrating a portion of the ring segment shown in FIG. 4.
Figure 6:
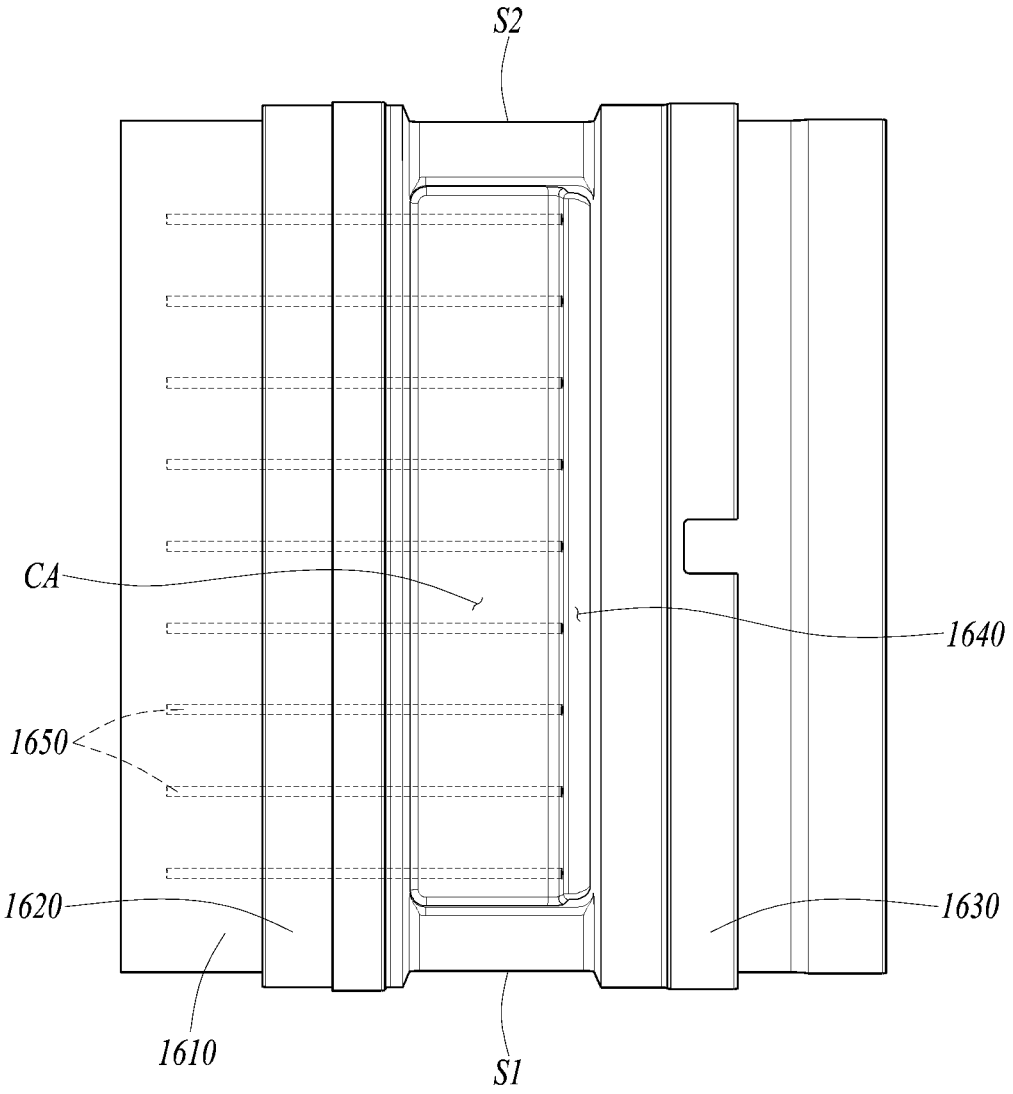
FIG. 6 is a top view illustrating the ring segment according to the first exemplary embodiment.
Figure 7:
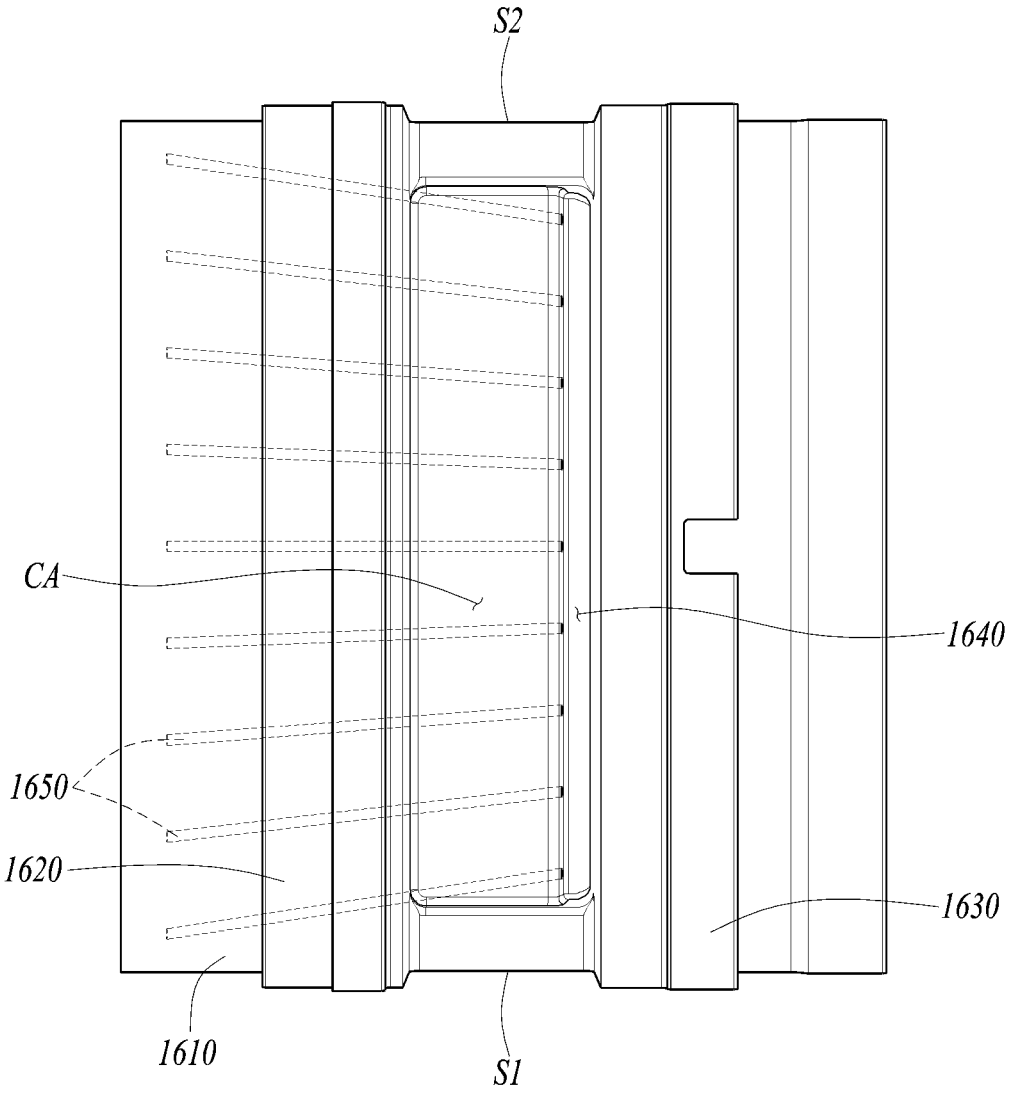
FIG. 7 is a top view illustrating a state of one ring segment according to a modified example of the first exemplary embodiment.
Figure 8:
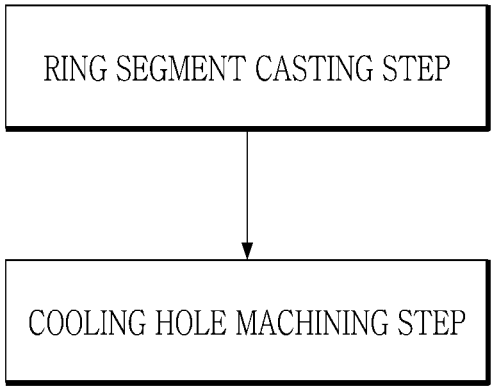
FIG. 8 is a flowchart illustrating a production process of the ring segment according to the first exemplary embodiment.

FIG. 3 is a perspective view illustrating a state of one ring segment according to a first exemplary embodiment. FIG. 4 is a side cross-sectional view illustrating the ring segment and outer peripheries of a turbine blade located radially inward of an associated ring segment according to the first exemplary embodiment. FIG. 5 is an enlarged side cross-sectional view illustrating a portion of the ring segment shown in FIG. 4. FIG. 6 is a top view illustrating the ring segment according to the first exemplary embodiment. FIG. 7 is a top view illustrating a state of one ring segment according to a modified example of the first exemplary embodiment. FIG. 8 is a flowchart illustrating a production process of the ring segment according to the first exemplary embodiment.

Hereinafter, the ring segment according to the first exemplary embodiment and the turbine including the same will be described in detail with reference to FIGS. 3 to 8.

The ring segment, which is designated by reference numeral 1600, may consist of a plurality of ring segments, which are mounted on the inner wall of the turbine casing 1800 and are continuously arranged in the circumferential direction (x direction) of the turbine casing 1800 to form a ring shape.

Although the ring segments 1600 are illustrated as being mounted on the turbine 1300 in the present embodiment, the present disclosure is not limited thereto. For example, the ring segments 1600 may also be mounted on a rotating machine such as the compressor 1100. Here, the rotating machine refers to an apparatus having rotating blades, including a compressor, a turbine, and so on.

The ring segments 1600 forming a ring shape surround the outer peripheries of the turbine blades 1400 in an annular manner with a tip clearance between the ring segment 1600 and the outer peripheries of the turbine blades 1400 to prevent a leakage of combustion gas. In addition, the ring segments 1600 are arranged alternately with the vanes 1500 in the longitudinal direction (y-axis direction) of the central axis of the turbine 1300. Each of the ring segments 1600 is inserted between the outer shrouds of the vanes 1500 to face the vanes 1500.

Each ring segment 1600 according to the first exemplary embodiment includes a shield wall 1610, a first hook 1620, a second hook 1630, an air pouch 1640, and a first cooling hole 1650.

The shield wall 1610 is positioned radially outwardly from the peripheries of the turbine blade 1400 and has an outer side that faces an inner wall of the turbine casing 1800 and an inner side that faces outer peripheries of the turbine blade 1400. The shield wall 1610 may have a plate shape with a substantially square cross-section. The shield wall 1610 may have a cavity CA defined in the center of the outer side thereof. The cavity CA is recessed inwardly from the outer side of the shield wall 1610 to a predetermined depth. A cooling fluid may be accommodated in the cavity CA. Here, the cooling fluid may be cooling air.

The first hook 1620 and the second hook 1630 are formed on the shield wall 1610. The first and second hooks 1620 and 1630 protrude from the shield wall 1610 toward the turbine casing 1800. The first and second hooks 1620 and 1630 may be inserted into grooves (not shown) formed in the turbine casing 1800 for coupling therewith. The first and second hooks 1620 and 1630 are elongated in the circumferential direction of the turbine. The first and second hooks 1620 and 1630 are disposed to face each other. The cavity CA is defined between the first hook 1620 and the second hook 1630 in the shield wall 1610.

Each turbine blade 1400 may be located radially inwardly from the associated ring segment 1600. Turbine blade 1400 includes an airfoil 1410 which has an airfoil cross-section and extends in the radial direction (y-axis direction) of the turbine. The airfoil 1410 has a leading edge LE and a trailing edge TE formed thereon. The leading edge LE is formed upstream in the direction of flow of combustion gas. The trailing edge TE is formed downstream in the direction of flow of combustion gas.

The first hook 1620 is located closer to the leading edge LE than the trailing edge TE of the airfoil 1410 on the outer side of the shield wall 1610. Contrary to the first hook 1620, the second hook 1630 is located closer to the trailing edge TE than the leading edge LE of the airfoil 1410 on the outer side of the shield wall 1610, and faces the first hook 1620.

The air pouch 1640 is recessed into the shield wall 1610. The air pouch 1640 is recessed further than the cavity CA in the cavity CA. The air pouch 1640 is recessed toward the turbine blade 1400. The air pouch 1640 may extend in the circumferential direction of the turbine in the shield wall 1610. When the ring segment 1600 is viewed from above, the air pouch 1640 may be parallel to the second hook 1630.

A cooling fluid may be accommodated in the air pouch 1640. The cooling fluid accommodated in the cavity CA may be supplied to the air pouch 1640. In this case, the state of the cooling fluid supplied to the air pouch 1640 may be the same as that of the cooling fluid accommodated in the cavity CA. That is, the temperature, pressure, density, flow rate, or the like of the cooling fluid supplied to the air pouch 1640 may be the same as that of the cooling fluid accommodated in the cavity CA.

The air pouch 1640 is formed on the side of the second hook 1630 rather than the first hook 1620. The air pouch 1640 has one side formed to be continuous with the inner surface of the second hook 1630. Here, one side of the air pouch 1640 refers to a portion closer to the second hook 1630 than the first hook 1620. In this case, the cross-section of one side of the air pouch 1640 may flush with the flat inner surface of the second hook 1630. When the cooling fluid in the cavity CA is supplied to the air pouch 1640, the cooling fluid may flow into the cavity CA connected to the inner surface of the second hook 1630, thereby minimizing vortex and turning loss.

The air pouch 1640 may have a bottom 1641 with a round portion 1642 formed thereon. The round portion 1642 may be formed at the edge of the bottom 1641 of the air pouch 1640, and may have a gentle curved shape in cross section. The round portion 1642 may be formed on one side of the air pouch 1640 close to the second hook 1630, and may also be formed on the other side of the air pouch 1640 close to the first hook 1620. The round portion 1642 may allow vortex and turning loss to be minimized when the cooling fluid in the cavity CA is supplied to the air pouch 1640.

The first cooling hole 1650 is formed in the shield wall 1610. The first cooling hole 1650 may be formed through the shield wall 1610 in a direction parallel to the axial direction (y-axis direction) of the turbine. That is, the first cooling hole 1650 may be formed in a direction intersecting a direction in which the first and second hooks 1620 and 1630 extend from the outer side of the shield wall 1610.

The first cooling hole 1650 has an inlet in communication with the air pouch 1640, and an outlet in communication with the outside of the first hook 1620 in the shield wall 1610. A cooling fluid flows in the first cooling hole 1650. The ring segment 1600 is cooled while the cooling fluid accommodated in the air pouch 1640 flows into the inlet of the first cooling hole 1650 and then flows to the outlet of the first cooling hole 1650.

The first cooling hole 1650 may consist of a plurality of first cooling holes. In this case, the plurality of first cooling holes 1650 may be arranged parallel to each other or radially with respect to the air pouch 1640. When the plurality of first cooling holes 1650 are arranged parallel to each other, the first cooling holes 1650 may be arranged parallel to each other at equal intervals (FIG. 6).

When the plurality of first cooling holes 1650 are radially arranged, the first cooling holes 1650 may be radially arranged so that the distance between the first cooling holes 1650 increases as they are away from the air pouch 140. As such, when the plurality of first cooling holes 1650 are formed in the shield wall 1610, the cooling performance of the ring segment 1600 may be maximized (FIG. 7).

As shown in FIG. 8, the ring segment 1600 may be manufactured in a casting step followed by a machining step. The casting step is a step of casting the ring segment 1600. In the casting step, the shield wall 1610, the first hook 1620, and the second hook 1630 are integrally cast. As described above, the cavity CA and the air pouch 1640 are formed in the shield wall 1610. The cavity CA and the air pouch 1640 are cast at once in the casting step. Advantageously, this does not require a separate process of forming the air pouch 1640.

The machining step is a step of machining the cooling hole. Here, the cooling hole includes a first cooling hole 1650 and a second cooling hole 1670, which will be described later. After the shield wall 1610 with the air pouch 1640 is formed in the casting step, the shield wall 1610 is machined to form the cooling hole therein in the machining step. In this case, the cooling hole may be formed through the shield wall 1610 by drilling or milling.

When the air pouch 1640 and the cooling hole are formed in the casting step and the machining step, there is no need to machine a separate vertical cooling hole (not shown). Therefore, it is possible to greatly reduce production time and cost.

The inlet of the first cooling hole 1650 may have a depth DP1 higher than the bottom 1641 of the air pouch 1640. That is, the air pouch 1640 may have a recessed depth DP2 greater than the depth DP1 of the inlet of the first cooling hole 1650. Since this requires lower precision in the process of forming the cooling hole in the machining step, the cooling hole machining process can be performed more easily.

Figure 9:
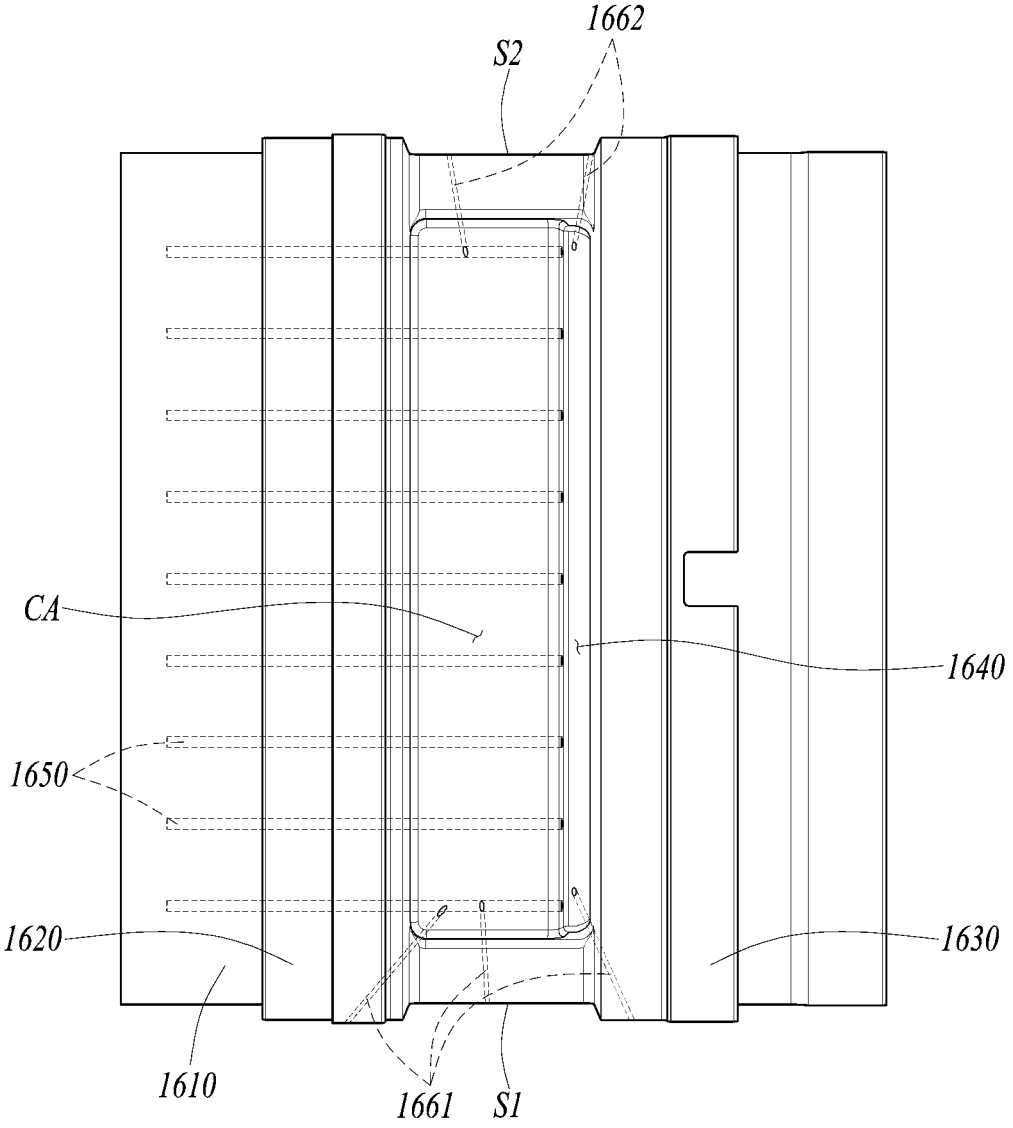
FIG. 9 is a top view illustrating a state of one ring segment according to a second exemplary embodiment.
Figure 10:
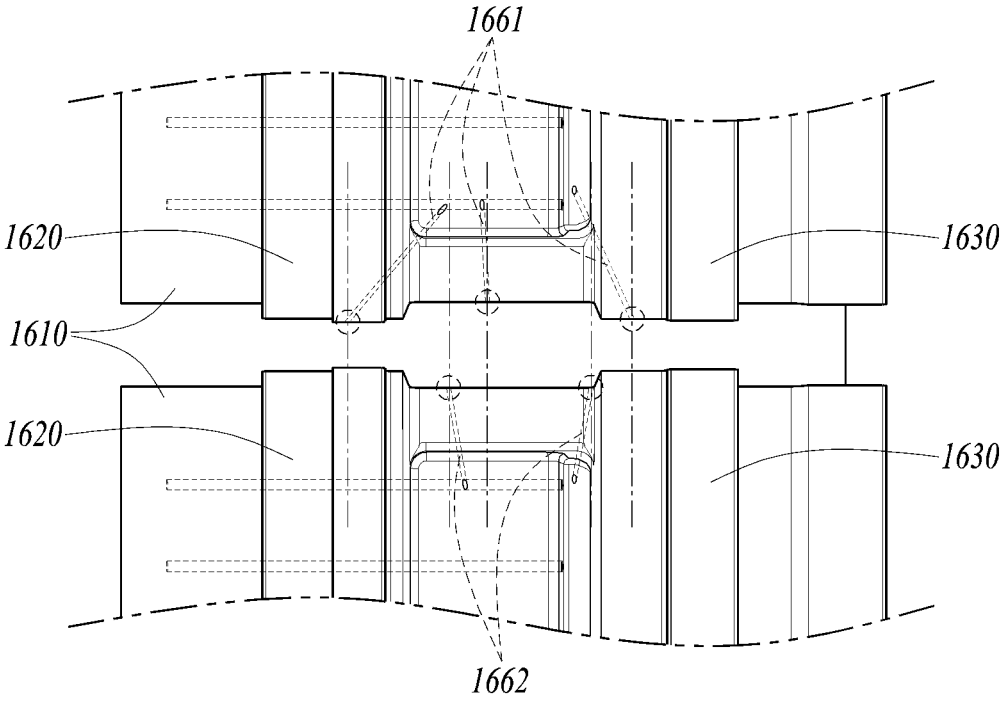
FIG. 10 is a top view illustrating two ring segments adjacent to each other according to the second exemplary embodiment.

FIG. 9 is a top view illustrating a state of one ring segment according to a second exemplary embodiment. FIG. 10 is a top view illustrating two ring segments adjacent to each other according to the second exemplary embodiment.

Hereinafter, the ring segment, which is designated by reference numeral 1600, according to the second exemplary embodiment will be described in detail with reference to FIGS. 9 to 10. Since the ring segment 1600 according to the second exemplary embodiment is the same as the ring segment 1600 according to the first exemplary embodiment except for a side hole, a redundant description thereof will be omitted.

The ring segment 1600 according to the second exemplary embodiment further includes a side hole. The side hole includes a first side hole 1661 and a second side hole 1662. The side hole is formed in the shield wall 1610. The shield wall 1610 has a first side S1, which is a side wall formed between the inner and outer side of the shield wall along the radial direction of the turbine, and a second side S2, which is opposite to the first side S1. In FIG. 9, the lower side of the shield wall 1610 is illustrated as the first side S1, and the upper side thereof is illustrated as the second side S2. The first side hole 1661 is formed through the first side S1, and the second side hole 1662 is formed through the second side S2. That is, the outlet of the first side hole 1661 is formed on the first side S1, and the outlet of the second side hole 1662 is formed on the second side S2. The formation of the side hole 1660 may improve the cooling performance of the ring segment 1600.

The side hole may consist of a plurality of side holes. That is, the first and second side holes 1661 and 1662 may consist of a plurality of side holes in combination. In this case, at least one of either the first or second side holes 1661 or 1662 may communicate with the air pouch 1640. For example, three first side holes 1661 and two second side holes 1662 may be formed, in which case one of the first side holes 1661 and one of the second side holes 1662 may communicate with the air pouch 1640.

Figure 11:
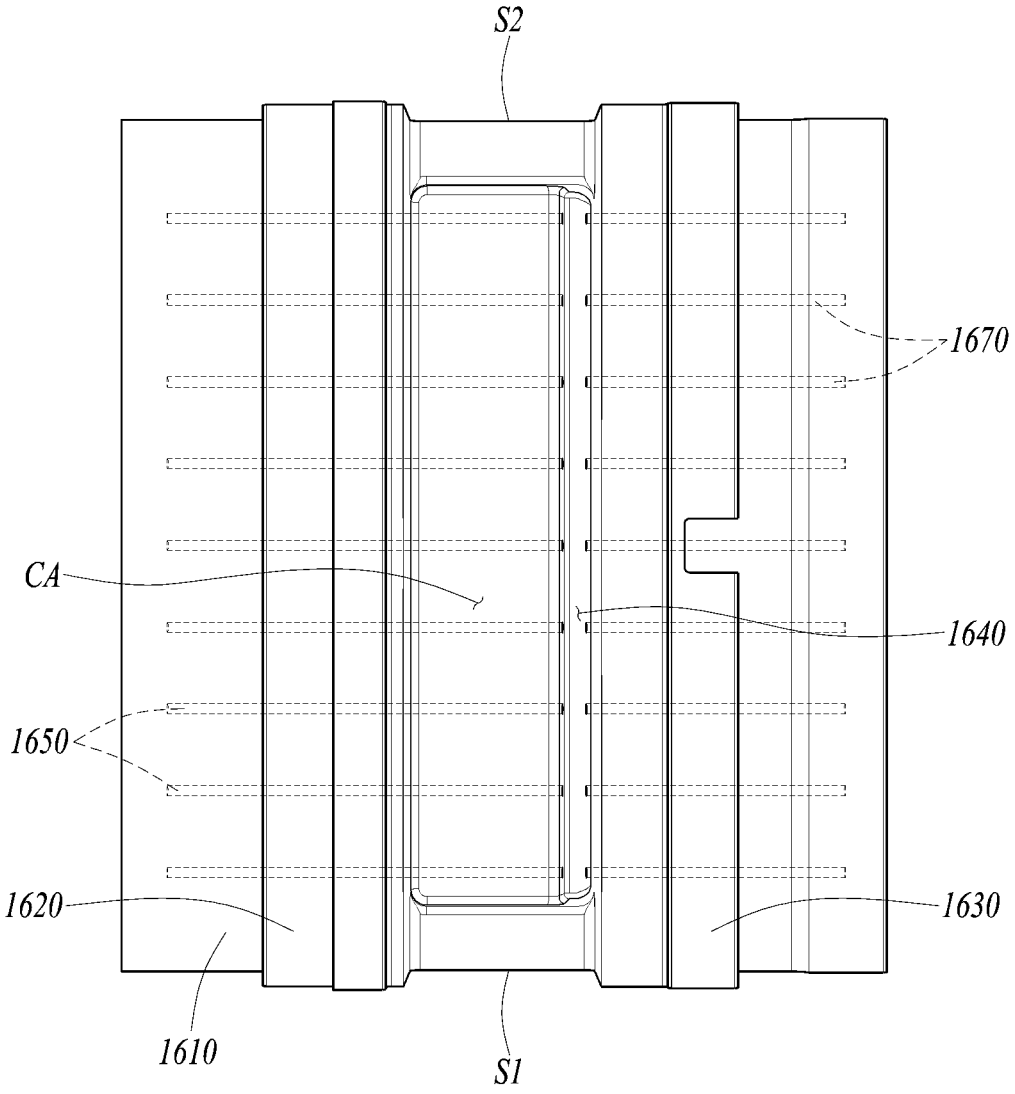
FIG. 11 is a top view illustrating a state of one ring segment according to a third exemplary embodiment.

As shown in FIG. 11, the first and second side holes 1661 and 1662 may be arranged alternately with each other when their outlets are placed on the same line. Specifically, in two ring segments 1600 adjacent to each other, when the first side hole 1661 of one ring segment 1600 and the second side hole 1662 of the other ring segment 1600 are disposed to face each other, the first side hole 1661 and the second side hole 1662 may be disposed alternately with each other. For example, when three first side holes 1661 of one ring segment 1600 are provided and two second side holes 1662 of the other ring segment 1600 are provided, the second side holes 1662 may be disposed respectively between the first side holes 1661 of one ring segment 1600. The arrangement of the side holes 1660 in this way may improve the cooling performance of the circumferential edge of the ring segment 1600.

FIG. 11 is a top view illustrating a state of one ring segment according to a third exemplary embodiment.

Hereinafter, the ring segment, which is designated by reference numeral 1600, according to the third exemplary embodiment will be described in detail with reference to FIG. 11. Since the ring segment 1600 according to the third exemplary embodiment is the same as the ring segment 1600 according to the first exemplary embodiment except for a second cooling hole 1670, a redundant description thereof will be omitted.

The ring segment 1600 according to the third exemplary embodiment further includes a second cooling hole 1670. The second cooling hole 1670 may be formed through the shield wall 1610 in a direction parallel to the axial direction of the turbine. That is, the second cooling hole 1670 may be formed in a direction intersecting a direction in which the first and second hooks 1620 and 1630 extend from the outer side of the shield wall 1610.

The second cooling hole 1670 has an inlet in communication with the air pouch 1640, and an outlet in communication with the outside of the second hook 1630 in the shield wall 1610. The cooling fluid flows in the second cooling hole 1670 like the first cooling hole 1650. The ring segment 1600 is cooled while the cooling fluid accommodated in the air pouch 1640 flows into the inlet of the second cooling hole 1670 and then flows to the outlet of the second cooling hole 1670. As such, when the second cooling hole 1670 is further formed in the shield wall 1610, the cooling performance of the ring segment 1600 may be further improved.

Meanwhile, the second cooling hole 1670 may consist of a plurality of second cooling holes disposed parallel to each other. The plurality of second cooling holes 1670 may be arranged alternately with the first cooling holes 1650.

As is apparent from the above description, in the ring segment and the turbine including the same according to the exemplary embodiments, the air pouch and the first cooling hole are formed in the shield wall, thereby achieving an improvement in cooling performance as well as simplification of production process.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims.

What is claimed is:

1. A ring segment mounted in a casing for accommodating a turbine blade, the ring segment comprising:

a shield wall having an outer side that faces an inner wall of the casing and an inner side that faces an outer periphery of the turbine blade;

a first hook and a second hook protruding from the outer side of the shield wall toward the casing for coupling therewith, the first and second hooks extending in a circumferential direction of the turbine and accommodating a cooling fluid therebetween;

an air pouch recessed from the outer side of the shield wall toward the turbine blade, one side of which is flush with an inner surface of the second hook; and at least one first cooling hole having an inlet in communication with the air pouch and an outlet in communication with an outside of the first hook in the shield wall.

2. The ring segment according to claim 1, wherein:

the turbine blade comprises an airfoil having a leading edge and a trailing edge formed thereon; and the second hook is located closer to the trailing edge than the leading edge.

3. The ring segment according to claim 1, wherein the air pouch has a recessed depth deeper than the inlet of the first cooling hole.

4. The ring segment according to claim 1, wherein:

the first cooling hole consists of a plurality of first cooling holes; and the plurality of first cooling holes are arranged parallel to each other or radially with respect to the air pouch.

5. The ring segment according to claim 1, wherein the air pouch has a bottom with a round portion formed at an edge thereof.

6. The ring segment according to claim 1, wherein the air pouch extends in the circumferential direction of the turbine, and is parallel to the second hook when viewed from above.

7. The ring segment according to claim 1, wherein the shield wall has a first side hole formed through a first side thereof and a second side hole formed through a second side thereof.

8. The ring segment according to claim 7, wherein at least one of the first and second side holes communicates with the air pouch, and the remainder communicates with the first cooling hole.

9. The ring segment according to claim 7, wherein, in two ring segments adjacent to each other, the first side hole of one ring segment is disposed alternatively with the second side hole of the other ring segment adjacent to the first side hole.

10. The ring segment according to claim 1, wherein:

the shield wall is cast with the air pouch formed therein; and the first cooling hole is formed by machining after the shield wall is cast.

11. The ring segment according to claim 1, further comprising at least one second cooling hole having a second inlet in communication with the air pouch and a second outlet in communication with an outside of the second hook in the shield wall.

12. A turbine comprising:

a rotatable turbine rotor disk;

a plurality of turbine blades disposed on the turbine rotor disk and each comprising an airfoil having a leading edge and a trailing edge formed thereon;

a casing configured to accommodate the turbine blades; and a ring segment mounted in the casing, wherein the ring segment comprises:

a shield wall having an outer side that faces an inner wall of the casing and an inner side that faces an outer periphery of the turbine blade;

a first hook and a second hook protruding from the outer side of the shield wall toward the casing for coupling therewith, the first and second hooks extending in a circumferential direction of the turbine and accommodating a cooling fluid therebetween;

an air pouch recessed from the outer side of the shield wall toward the turbine blade, one side of which is flush with an inner surface of the second hook; and at least one first cooling hole having an inlet in communication with the air pouch and an outlet in communication with an outside of the first hook in the shield wall.

13. The turbine according to claim 12, wherein the air pouch has a recessed depth deeper than the inlet of the first cooling hole.

14. The turbine according to claim 12, wherein:

the first cooling hole consists of a plurality of first cooling holes; and the plurality of first cooling holes are arranged parallel to each other or radially with respect to the air pouch.

15. The turbine according to claim 12, wherein the air pouch has a bottom with a round portion formed at an edge thereof.

16. The turbine according to claim 12, wherein the air pouch extends in the circumferential direction of the turbine, and is parallel to the second hook when viewed from above.

17. The turbine according to claim 12, wherein the shield wall has a first side hole formed through a first side thereof and a second side hole formed through a second side thereof.

18. The turbine according to claim 17, wherein at least one of the first and second side holes communicates with the air pouch, and the remainder communicates with the first cooling hole.

19. The turbine according to claim 17, wherein, in two ring segments adjacent to each other, the first side hole of one ring segment is disposed alternatively with the second side hole of the other ring segment adjacent to the first side hole.

20. The turbine according to claim 12, further comprising at least one second cooling hole having a second inlet in communication with the air pouch and a second outlet in communication with an outside of the second hook in the shield wall.

* * * * *